US007722476B2

(12) United States Patent
Pedraza et al.

(10) Patent No.: US 7,722,476 B2
(45) **Date of Patent: *May 25, 2010**

(54) GOLF CLUB

(75) Inventors: Luis Pedraza, Roxbury, MA (US); Bryan R. Hotaling, Arlington, MA (US)

(73) Assignee: Axis1, LLC, West Roxbury, MA (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/166,050

(22) Filed: Jul. 1, 2008

(65) Prior Publication Data

US 2008/0287211 A1 Nov. 20, 2008

Related U.S. Application Data

(63) Continuation of application No. 11/149,874, filed on Jun. 10, 2005, now Pat. No. 7,407,445.

(51) Int. Cl.
*A63B 53/04* (2006.01)

(52) U.S. Cl. ..... 473/314; 473/340

(58) Field of Classification Search ..... 473/314, 473/340–342, 349, 313
See application file for complete search history.

(56) References Cited

U.S. PATENT DOCUMENTS

| | | | | | |
|---|---|---|---|---|---|
| 1,705,250 | A | * | 3/1929 | Hincks | 473/251 |
| 2,926,913 | A | * | 3/1960 | Stecher | 473/314 |
| 3,194,564 | A | | 7/1965 | Swan | |
| D235,566 | S | * | 6/1975 | Cook | D21/744 |
| 3,967,826 | A | | 7/1976 | Judice | |
| 4,063,733 | A | | 12/1977 | Benedict | |
| 4,265,452 | A | | 5/1981 | Vella | |
| 4,290,606 | A | * | 9/1981 | Maxwell | 473/569 |
| 4,383,690 | A | * | 5/1983 | Maxwell | 473/252 |
| 4,597,578 | A | * | 7/1986 | Lancaster | 473/300 |
| 4,650,191 | A | | 3/1987 | Mills | |
| 4,846,477 | A | | 7/1989 | Phelan | |
| 4,852,879 | A | * | 8/1989 | Collins | 473/251 |
| 4,988,107 | A | | 1/1991 | Sasse | |
| D317,807 | S | | 6/1991 | Adams | |
| 5,078,398 | A | * | 1/1992 | Reed et al. | 473/313 |
| 5,183,255 | A | * | 2/1993 | Antonious | 473/314 |
| 5,199,707 | A | * | 4/1993 | Knox | 473/314 |
| 5,312,105 | A | * | 5/1994 | Cleveland | 473/350 |

(Continued)

FOREIGN PATENT DOCUMENTS

JP 08257184 A * 10/1996

OTHER PUBLICATIONS

International Search Report and Written Opinion of the International Searching Authority for International Application No. PCT/US2009/060420, mailed Dec. 3, 2009, 8 pages.

*Primary Examiner*—Stephen L. Blau
(74) *Attorney, Agent, or Firm*—Michael J. Gallagher; David J. Dawsey; Gallagher & Dawsey Co., LPA

(57) ABSTRACT

A golf club with a shaft and an asymmetrical head, wherein said head has a gravitational center which is further from a trailing edge than said striking face and is disposed on a vertical plane which includes said grip axis.

16 Claims, 13 Drawing Sheets

U.S. PATENT DOCUMENTS 5,375,840 A * 12/1994 Hirsch et al. ..... 473/291
5,441,268 A 8/1995 Shier
5,544,883 A 8/1996 Meyer
5,601,498 A * 2/1997 Antonious ..... 473/305
5,607,363 A * 3/1997 Chou ..... 473/287
5,620,379 A 4/1997 Borys
5,716,288 A * 2/1998 Sacco ..... 473/290
5,816,935 A * 10/1998 Se-Hyup ..... 473/313
5,890,971 A * 4/1999 Shiraishi ..... 473/291
5,938,538 A * 8/1999 Broadbridge et al. ..... 473/252
6,017,281 A 1/2000 Behling
6,024,653 A * 2/2000 Goodrich ..... 473/314
6,217,459 B1 * 4/2001 Purcell ..... 473/313
6,261,190 B1 * 7/2001 Ashcraft ..... 473/251
6,319,146 B1 * 11/2001 Mills ..... 473/244
6,350,208 B1 2/2002 Ford
6,379,262 B1 * 4/2002 Boone ..... 473/324
D458,658 S 6/2002 Jung
6,991,559 B2 * 1/2006 Yabu ..... 473/332
7,101,288 B2 9/2006 Thomas
7,407,445 B2 8/2008 Pedraza
2001/0001771 A1 * 5/2001 Peters et al. ..... 473/291
2003/0045369 A1 * 3/2003 Murray et al. ..... 473/300
2003/0220149 A1 * 11/2003 Mills ..... 473/246
2004/0029647 A1 2/2004 Bennett
2004/0058741 A1 * 3/2004 Covington ..... 473/314
2004/0152533 A1 * 8/2004 Sery ..... 473/242
2004/0229711 A1 * 11/2004 Trumble et al. ..... 473/340
2005/0164805 A1 7/2005 Durnin
2005/0215346 A1 9/2005 Iwade
2005/0227778 A1 10/2005 Pollman
2006/0116218 A1 * 6/2006 Burnett et al. ..... 473/349
2006/0281578 A1 12/2006 Pedraza

* cited by examiner

GOLF CLUB

CROSS REFERENCE TO RELATED APPLICATIONS

This application is a continuation of U.S. patent application Ser. No. 11/149,874, filed on Jun. 10, 2005 now U.S. Pat. No. 7,407,445, which is hereby incorporated by reference in its entirety.

TECHNICAL FIELD

This invention relates generally to golf clubs, and more particularly to golf putters.

BACKGROUND

Many golf club designs have been introduced to improve golfers' accuracy, such as adding materials to dampen the impact with the ball, aligning the shaft with the club face placing the shaft forward of the club face, aligning the shaft with the center of gravity of the club head, adding enlarged alignment features, etc.

SUMMARY

It is desirable to strike a golf ball as squarely as possible on the "sweet spot" of the club face in order to properly hit the ball. The sweet spot is the preferred striking point on the club face. If the center gravity of the head of the club is not aligned with the grip axis, there is a tendency for the club head to rotate about the grip axis. When this occurs, the player must compensate for the rotation of the club. This rotation adds an additional variable to the complex nature of the golf swing. However, by placing the center of gravity proximate to the grip axis, the rotation of the club head about the grip axis is minimized, thereby minimizing one factor from the complex nature of the golf swing. Further, it is desirable to align the grip axis proximate to the striking face of the club head or slightly ahead of the clubface (using an offset hosel) in order to strike the ball with a more natural stroke. Further, it is desirable that the club head have substantial depth to allow for alignment features.

According to one aspect of the invention, a golf club (such as a putter) includes a shaft, a grip and a head. The grip is at an upper end of the shaft and defines a grip axis inclined with respect to the vertical, the inclined grip axis defining a vertical plane, such as with the club held in its intended position to address a golf ball. The grip defines a radius about the grip axis. The head is secured to a lower end of said shaft and has a striking face and a trailing edge. Notably, the head has a gravitational center which is further from the trailing edge than the striking face and is spaced from the vertical plane a distance less than the grip radius.

In some embodiments, the center of gravity is within 0.84 inch of a striking face and in a vertical plane which includes the grip axis and yet has substantial depth of the putter to allow for alignment features. The golf club having a head with counterbalance weight forward of the striking surface positioned in such a way that the mass distribution will result in the center of gravity of the club head being aligned with the vertical plane created by the axis of the putter shaft. In some embodiments, positioning the center of gravity on the vertical plane defined by the axis of the shaft causes the club head is balanced about the axis while addressing the ball. In other embodiments, positioning the center of gravity on the axis of the shaft causes the club head to be balanced as it is rotated about the axis of the shaft. In addition, by locating the center of gravity at the intersection of the vertical plane created by the line defining the ideal striking location and on the axis of the shaft, the golf club will be in perfect balance and not rotate in the player's hand while the player addresses or strikes a golf ball.

In some embodiments, the head is asymmetrical, such as about the vertical plane containing the inclined grip axis as the club is positioned in contact with a ball.

The preferred proximity of the gravitational center will vary with grip radius in many cases. In some embodiments, the gravitational center is spaced less than about 0.65 inch from the vertical plane. In some cases, less than 0.5 inch, or even less than 0.3 inch.

Preferably, the gravitational center is disposed substantially on the vertical plane, and even more preferably substantially on the grip axis itself.

In some constructions, the gravitational center is disposed less than the grip radius from the striking face, and may be forward of the striking face, such as less than 0.84 inch or a standard golf ball radius forward of the striking face.

In some embodiments, the gravitational center coincides with a preferred striking point of the striking face.

In many clubs the striking face is oriented to impart a force in a direction substantially normal to the vertical plane.

In some constructions the head is formed using of a single material, and may include an alignment aid on the trailing edge. In some other cases the head is formed from a plurality of materials of different densities, and may have removable heel and toe counterweights. In some instances the club is provided in combination with replacement heel and toe counterweights of different weights, such that the user may adjust the weight or weight distribution of the head.

According to another aspect of the invention, a golf club includes a shaft having a grip region at an upper end, and a head. The grip region defines a grip axis. The head is secured to a lower end of said shaft and has a forward face and a trailing edge. Notably, the head has a gravitational center which is disposed further from the trailing edge than the striking face and substantially on the grip axis.

Various embodiments of this aspect of the invention feature various characteristics described above. In some cases the gravitational center is disposed substantially at a point defined by the grip axis and a sweet spot on the forward face of the head.

According to yet another aspect of the invention, a golf club has a shaft, a grip and a head. The grip is disposed at an upper end of the shaft, and defines a grip axis inclined with respect to the vertical, such that the inclined grip axis defines a vertical plane as the putter is held so as to address a golf ball. The grip defines a radius about the grip axis. A plurality of parts are assembled to form the head, secured to a lower end of said shaft, the head having a striking face and a trailing edge. Notably, the head has a gravitational center which is further from the trailing edge than the striking face, and is spaced from the vertical plane a distance less than the grip radius.

Various embodiments of this aspect of the invention feature various characteristics described above. In some cases the gravitational center is disposed substantially on the grip axis.

Other aspects of the invention feature methods of making the golf club disclosed herein, and methods of using such a club to strike a golf ball.

The details of one or more embodiments of the invention are set forth in the accompanying drawings and the description below. Other features, objects, and advantages of the invention will be apparent from the description and drawings, and from the claims.

DESCRIPTION OF DRAWINGS

Like reference symbols in the various drawings indicate like elements.

DETAILED DESCRIPTION

Figure 1:
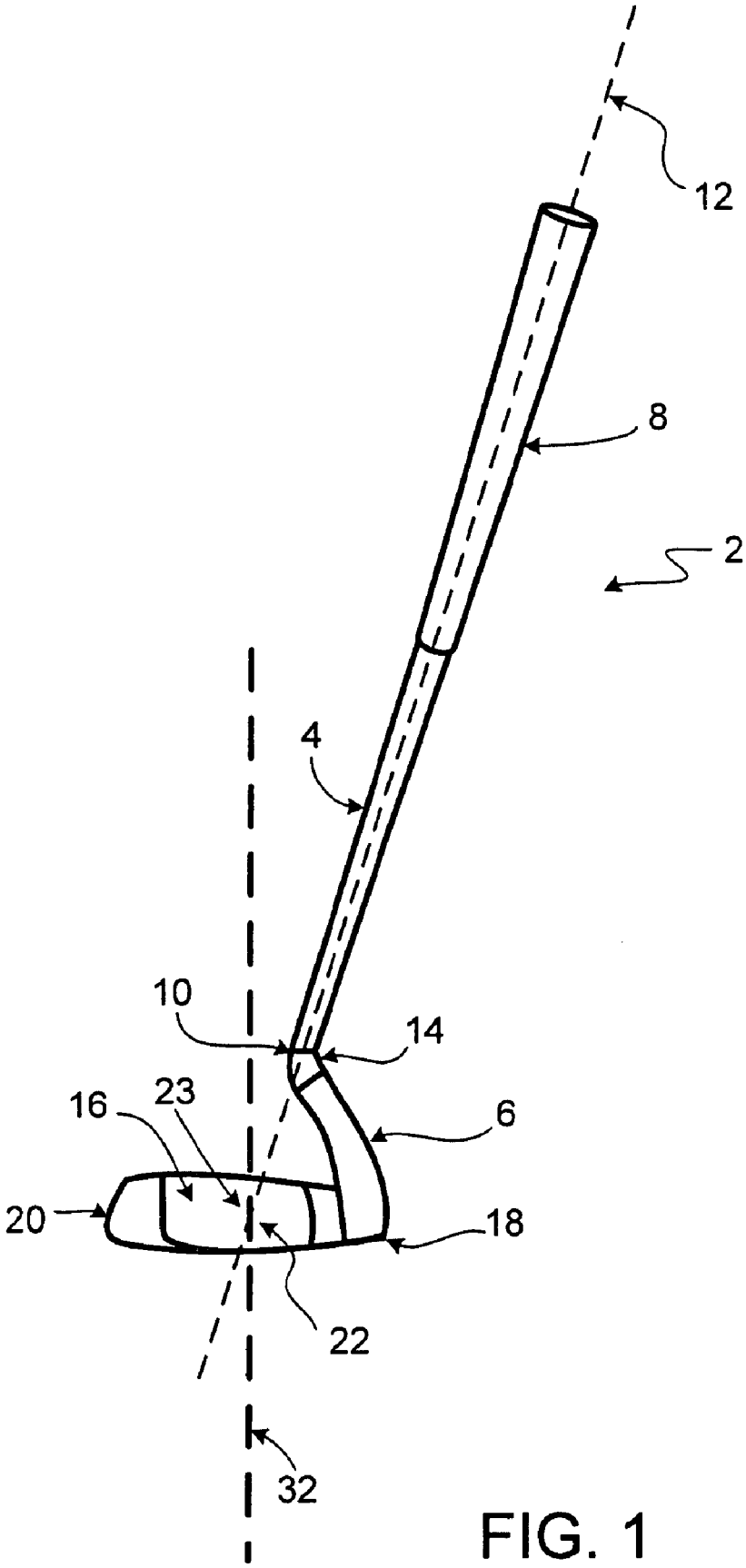
FIG. 1 is one embodiment of a golf club.

FIG. 1 is one embodiment of a golf club (2). The golf club (2) consists of two major components the shaft (4) and a head (6). The golf club (2) is assembled in a manner customary to the industry.

The shaft (4) consists of a grip region (8) and a lower end (10). The grip region (8) is conformed to be held by a person. The grip region (8) defines an axis (12) which intersects the center of gravity (22) of the head (6). The grip region (8) may be fitted with the material selected for comfort and control. The lower end (10) is secured to the hosel (14) of the head (6). In the present embodiment, the shaft (4) intersects the center of gravity of the head (6). Typically, the axis (12) is inclined with respect to a vertical axis (32). In other words, it is typically not perpendicular to a horizontal surface. The incline of axis (12) defines a vertical plane. In some embodiments the head (6) may be asymmetrical with respect to the vertical plane.

The head (6) consists of a hosel (14), a striking face (16), and a trailing edge (not shown in this view.) In the embodiment shown, the hosel (14) is attached to the heel (18) of the head (6). The striking face (16) is located between the heel (18) and the toe (20). The mass of the head (6) is distributed such that the center of gravity (22) of the head (6) is located proximate to the center of the striking face (16) and on axis (12). In some embodiments, the mass of the head (6) is distributed such that the center of gravity (22) is located slightly in front or on the striking face (16). In other embodiments, the mass of the head (6) is distributed such that the center of gravity (22) may be located slightly behind the striking face (16). The striking face (16) may have either a positive or negative inclination. By distributing the mass of head (6) such that the center of gravity (22) lies on axis (12), the club is less likely to twist while a user addresses the ball. In this embodiment, the sweet spot (23) on striking face (16) is located proximate to the center of gravity (22) and does not coincide with the center of gravity (22). However, in other embodiments, wherein the center of gravity (22) lies on striking face (16), the sweet spot (23) may be located at the same point as the center of gravity. In some embodiments, the center of gravity (22) is located proximate to the vertical plane. In some embodiments, the center of gravity (22) is located proximate to the axis (12). In other embodiments, the center of gravity (22) is located proximate to the axis (12) and the striking face of head (6).

Figure 2:
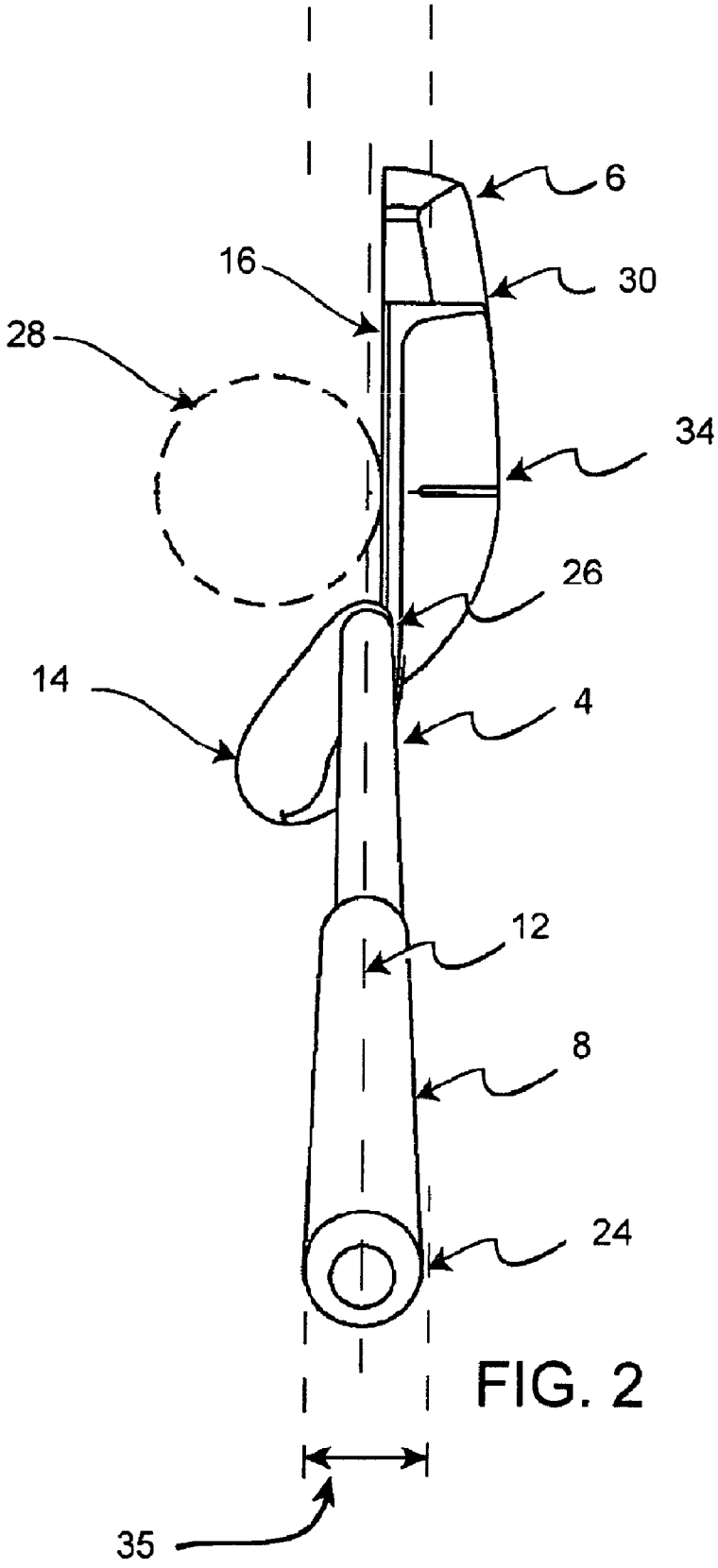
FIG. 2 is a top view the golf club of FIG. 1 in relationship to a golf ball.

FIG. 2 is a top view the embodiment of FIG. 1 in relationship to a golf ball (28). The shaft (4) consists of the grip region (8) at the upper end (24) and a lower end (26). The grip region (8) defines the axis (12), which as shown in this view is located upper to and front of striking face (16). The lower end (26) of shaft (4) is secured to the hosel (14) of the head (6).

The head (6) consists of the hosel (14), the front face (16), the trailing edge (30), the heel (18), and the toe (20). The striking face (16) is designed to impart a momentum in a vertical plane that includes vertical axis (32). Vertical axis (32), as shown in FIG. 1, is defined as a vertical line intersecting sweet spot (23) and axis (12). The momentum imparted to golf ball (28) may be either positively inclined to vertical axis (32), negatively inclined to vertical axis (32) or on vertical axis (32). The trailing edge (30) may further include an alignment aid (34). This embodiment features a substantial alignment aid (34) while maintaining the center of gravity proximate the striking face (16). The alignment aid (34) is designed to assist the user, while the user addresses a golf ball (28). Clubs without enlarged trailing edges tend to have short sight lines which would inhibit a golfer's ability to line up the club, the ball and the hole.

Figure 2A:
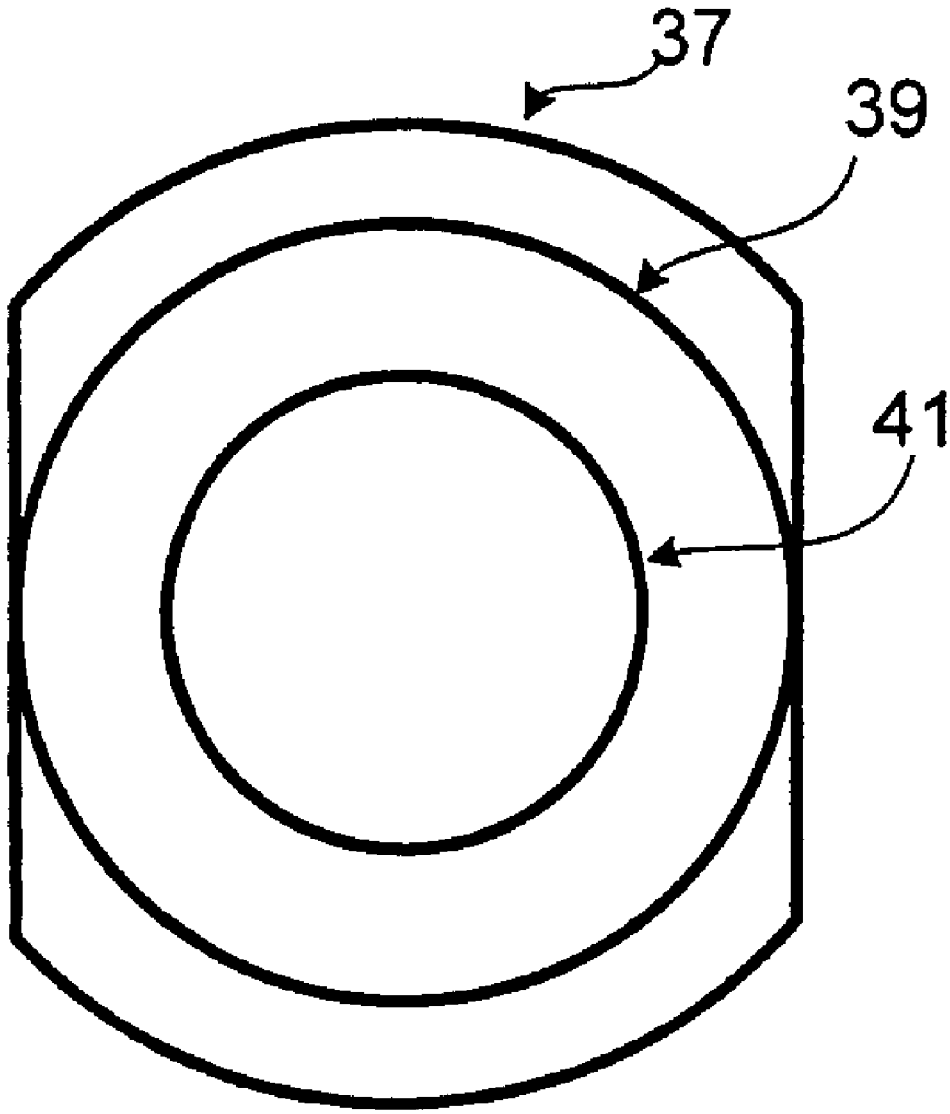
FIG. 2A is a top view of the golf club shaft of FIG. 1.

Turning to FIG. 2A, in the embodiment shown, the shaft diameter measures 0.6 inch across. The grip region (8) diameter (35) may vary. However, in some embodiments, the grip region (8) is 1.0 inch across the narrow side and 1.3 inches across the widest part.

Figure 3A:
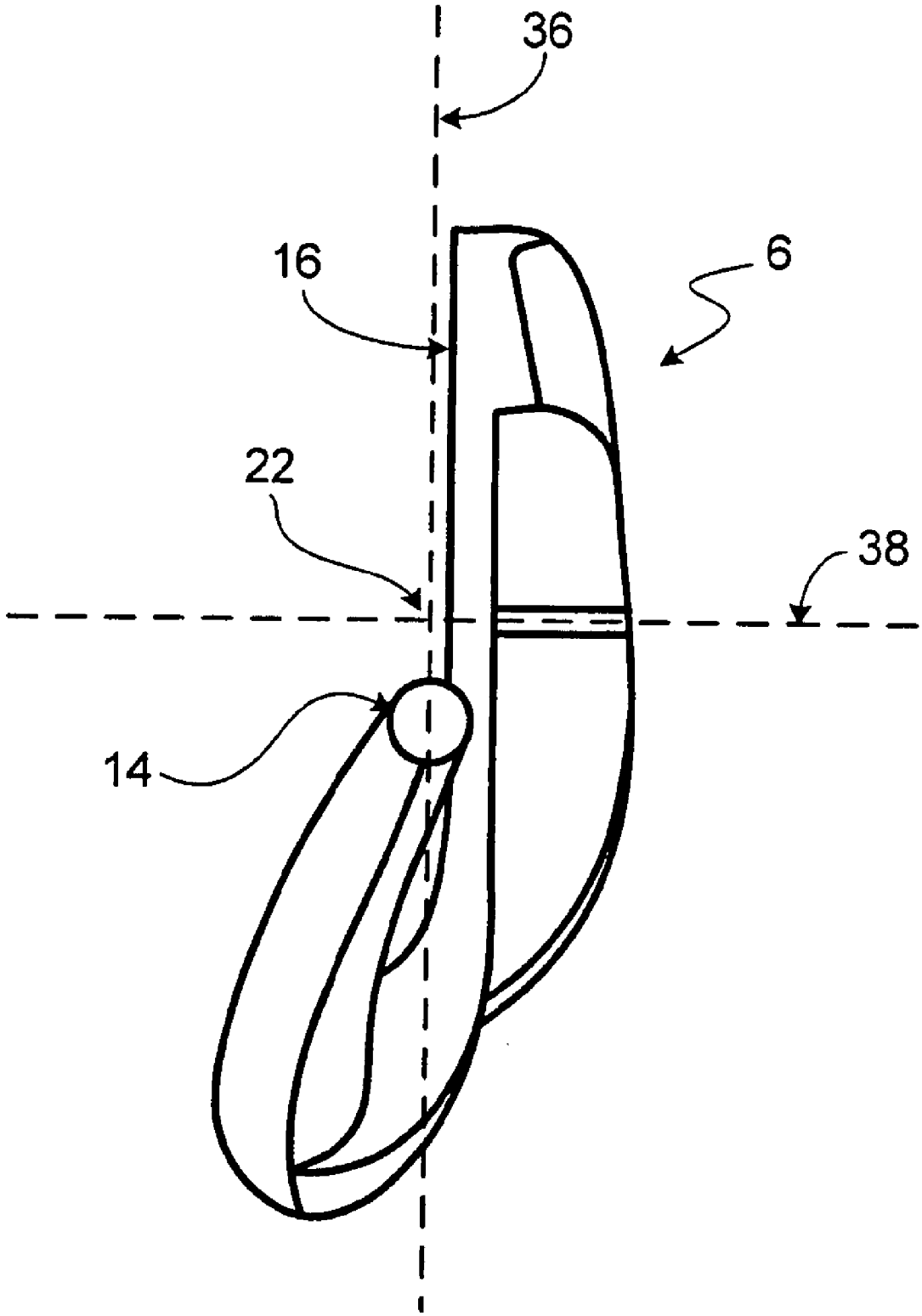
FIG. 3A is a top view of the golf club head of FIG. 1.

FIG. 3A is a top view of the head (6) without the shaft. The head (6) is shown in relationship to plane A (36) and plane B (38). The center of gravity (22) of the head (6) lies proximate to the sweet spot (23) on striking face (16) and the intersection of plane A (36) and plane B (38). Vertical axis (32) (not shown in this view) is a vertical line that lies in plane B (38) and intersects the sweet spot (23). In this embodiment, the head (6) is constructed from a single material and the proper mass distribution is accomplished by selecting the shape of the head (6).

Figure 3B:
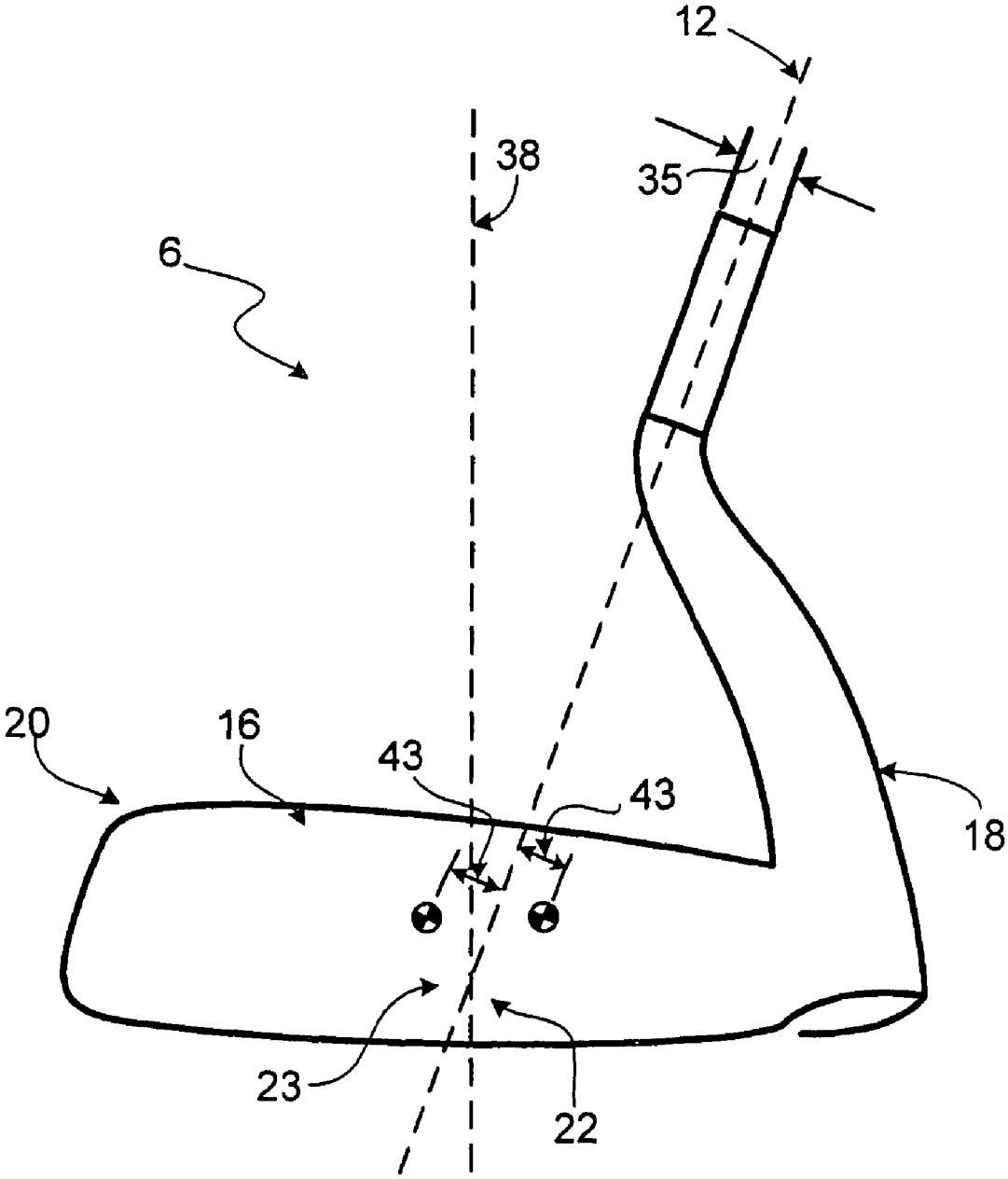
FIG. 3B is a front view of the golf club head of FIG. 1.

FIG. 3B is a front view of the head (6) without the shaft. The opening of the hosel (14) is aligned with axis (12). The center of gravity (22) of the head (6) is proximate to the intersection of the axis (12), which extends from the grip region (not shown in this view), plane A (36), and plane B (38). In this embodiment, mass distribution of the head (6) is such that the center of gravity (22) is in front of striking face (16) and is located roughly at the center of the striking face (16). As can be seen in this view, the location of the center of mass (22) of the head (6) is accomplished by balancing the mass of the toe (20) with the mass of the heel (18) such that the center of mass of the head (6) is proximate to the center of the striking face (16). The center of mass may be located within half of the diameter (35) as shown by dimension (43).

Figure 3C:
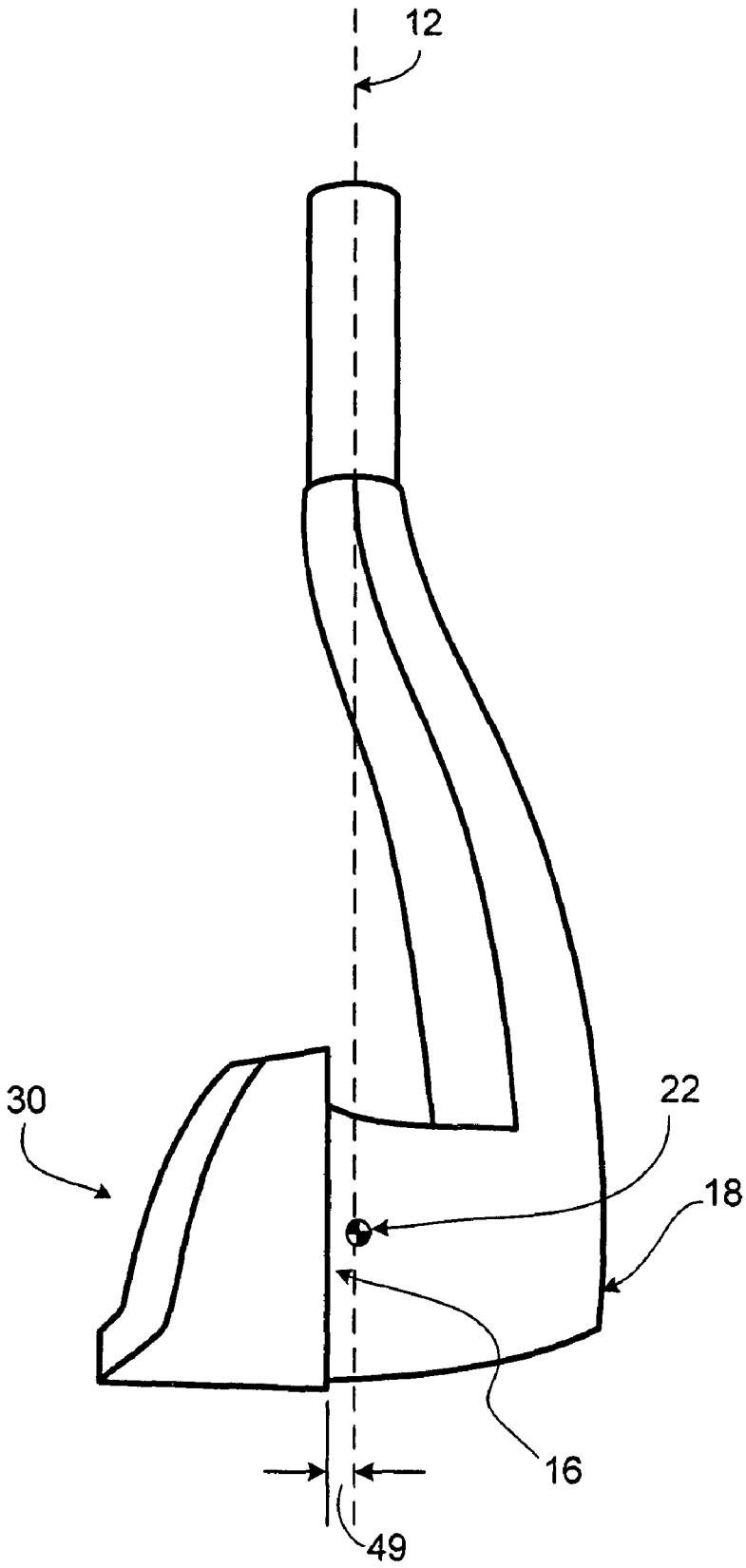
FIG. 3C is a side view from the toe of the golf club head of FIG. 1.

FIG. 3C is a side view from the toe side of the head (6) without the shaft. The center of mass of the trailing edge (30) is located behind axis (12) (not shown in this view) which lies on plane A (36). In contrast, the center of mass of the heel (18) is located forward of the striking face (16). In the present embodiment, this causes the gravitational center (22) to be located slightly in front of striking face (16) and on axis (12). In some embodiments, it may be advantageous to locate the gravitational center (22) above the sweet spot (23). In other embodiments, it may be advantageous to locate the gravitational center (22) below the sweet spot (23). In other embodiments the gravitational center may be located a distance (49) from the striking face. The distance (49) may be up to 0.84 inch.

Figure 3D:
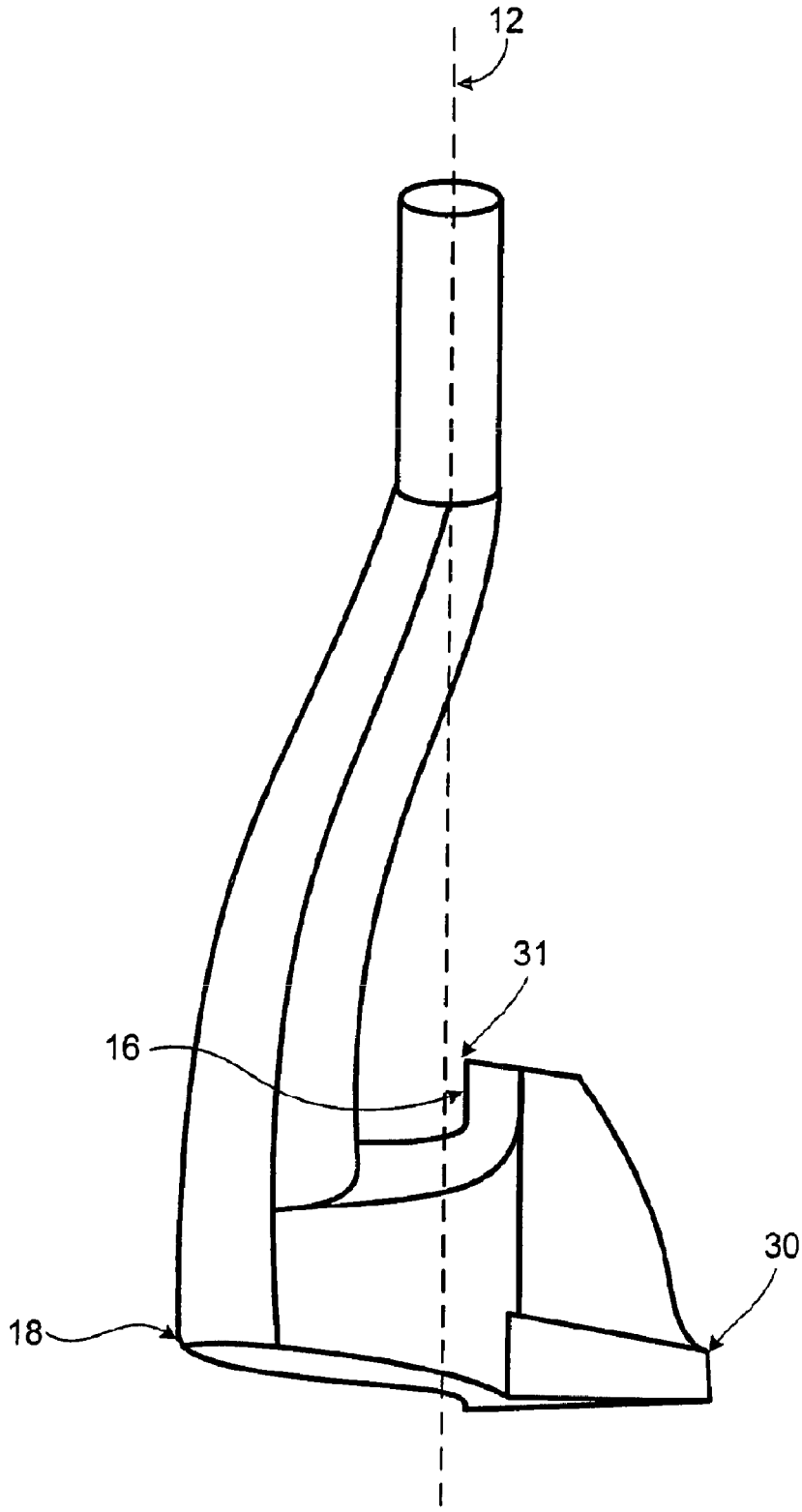
FIG. 3D is a side view from the heel of the golf club head of FIG. 1.
Figure 3E:
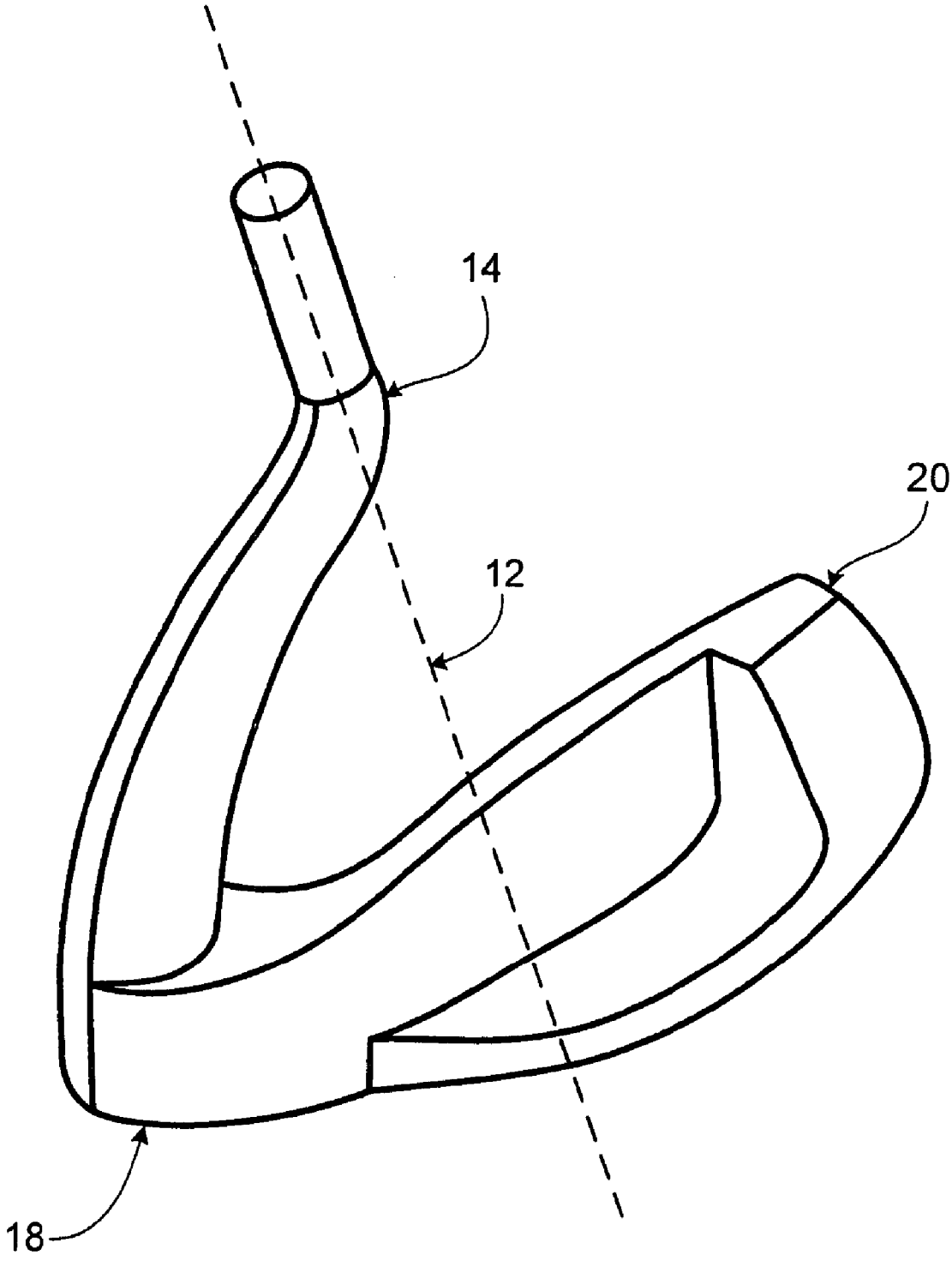
FIG. 3E is an isometric view from the rear of the golf club head of FIG. 1.

FIG. 3D is a side view from the heel side of the head (6) without the shaft. In this embodiment, the axis (12) lies a small distance in front of the striking face (16). The center of gravity (not shown in this view) lies on the axis (12) and is a small distance in front of the striking face (16) as shown by gap (31). The mass of the head (6) is shifted in front of the striking face (16) by shifting a majority of the mass of head (6) toward the heel (18) and less of the mass of head (6) toward the trailing edge (30). The gap (31) is preferably less than 0.84 inches forward of the striking face (16). FIG. 3E is an isometric view of the asymmetrical golf club head of FIG. 1. In addition to the forward weight distribution at heel (18), a counterbalance is located at toe (20). The mass of heel (18) and hosel (14) causes the gravitational center (22) to shift forward. It also causes the gravitational center (22) to shift below axis (12). In order to bring the gravitational center (22) back into line with axis (12), a counterbalance is located proximate to toe (20).

Figure 3F:
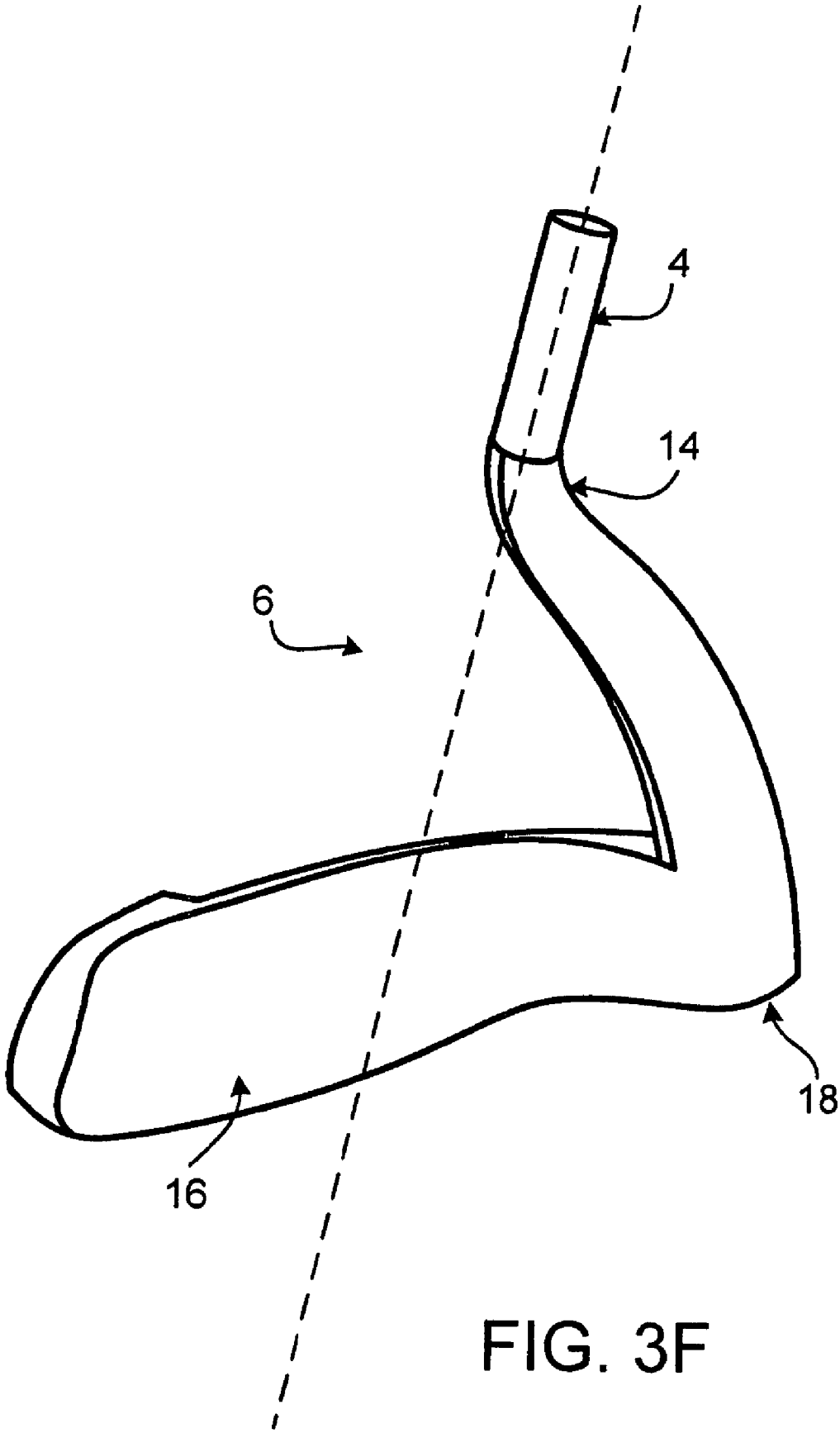
FIG. 3F is an isometric view from the front of the golf club head of FIG. 1.

FIG. 3F is an isometric view from the toe side of the head (6) without the shaft. The shaft (4) is secured to hosel (14). At this juncture the heel (18) sweeps forward to shift a portion of the mass of head (6) forward. Then from the heel (18) the head (6) curves back to place the striking face (16) behind the axis (12). This placement allows a player to address a ball in such a manner that the axis (12) lines up with the center of gravity of head (6) and thereby, minimizing the torque caused by head (6).

Figure 4:
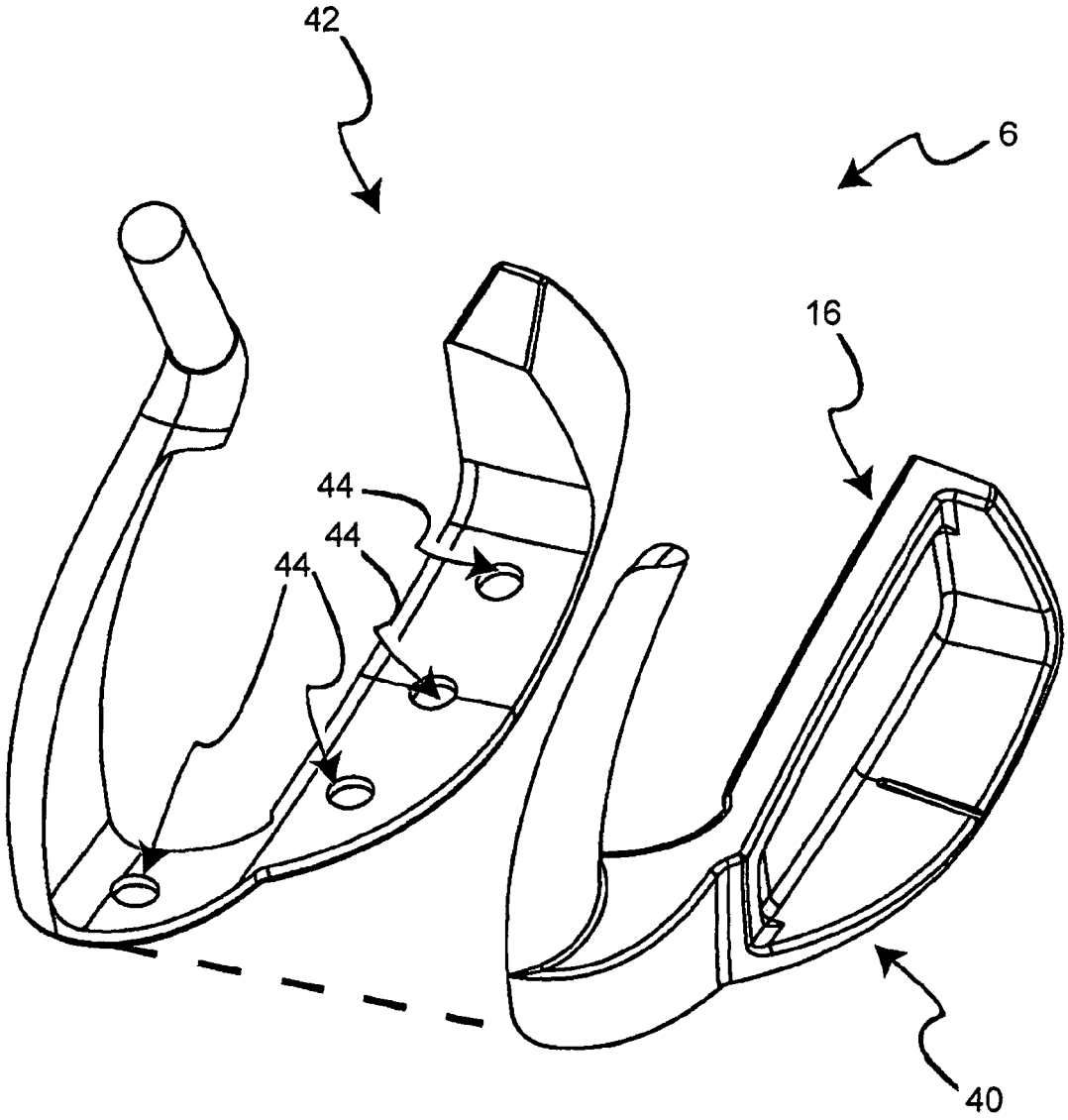
FIG. 4 is another embodiment of a golf club head.

FIG. 4 is an exploded view of one embodiment of the head (6) of FIG. 3A. The embodiment shown in FIG. 4 is constructed using two materials of different densities in order to accomplish the proper weight distribution. The placement of the center of gravity (22) in front of the striking face (16) may be accomplished by selecting a lower density material for face (40) then the material selected for base (42). One possible combination is to manufacture face (40) from 6061-T6 Aluminum and to manufacture base (42) from 304 Steel. The location of the center of gravity (22) may be changed by selecting different materials as needed.

Base (42) includes a plurality of openings (44) through which fasteners may be inserted to secure face (40) to base (42). Alternatively, other options include methods such as tongue and groove, insert molding, adhesives, or screwing them together.

In this embodiment, the head (6) is constructed from two parts of different materials. In other embodiments, the head (6) may be constructed from even more parts and materials. For example, face (40), the heel and the toe can be manufactured as three separate steel parts. The proper mass distribution may be accomplished by either varying the densities of the materials selected or varying the densities of the materials selected in combination with the shape of the head and by having interchangeable heel and toe weights.

In other embodiments, removable heel and toe counterweights may be included. The heel and toe counter weights may be removed and replaced by counterweights of different weights in order to make the club lighter or heavier.

Figure 5A:
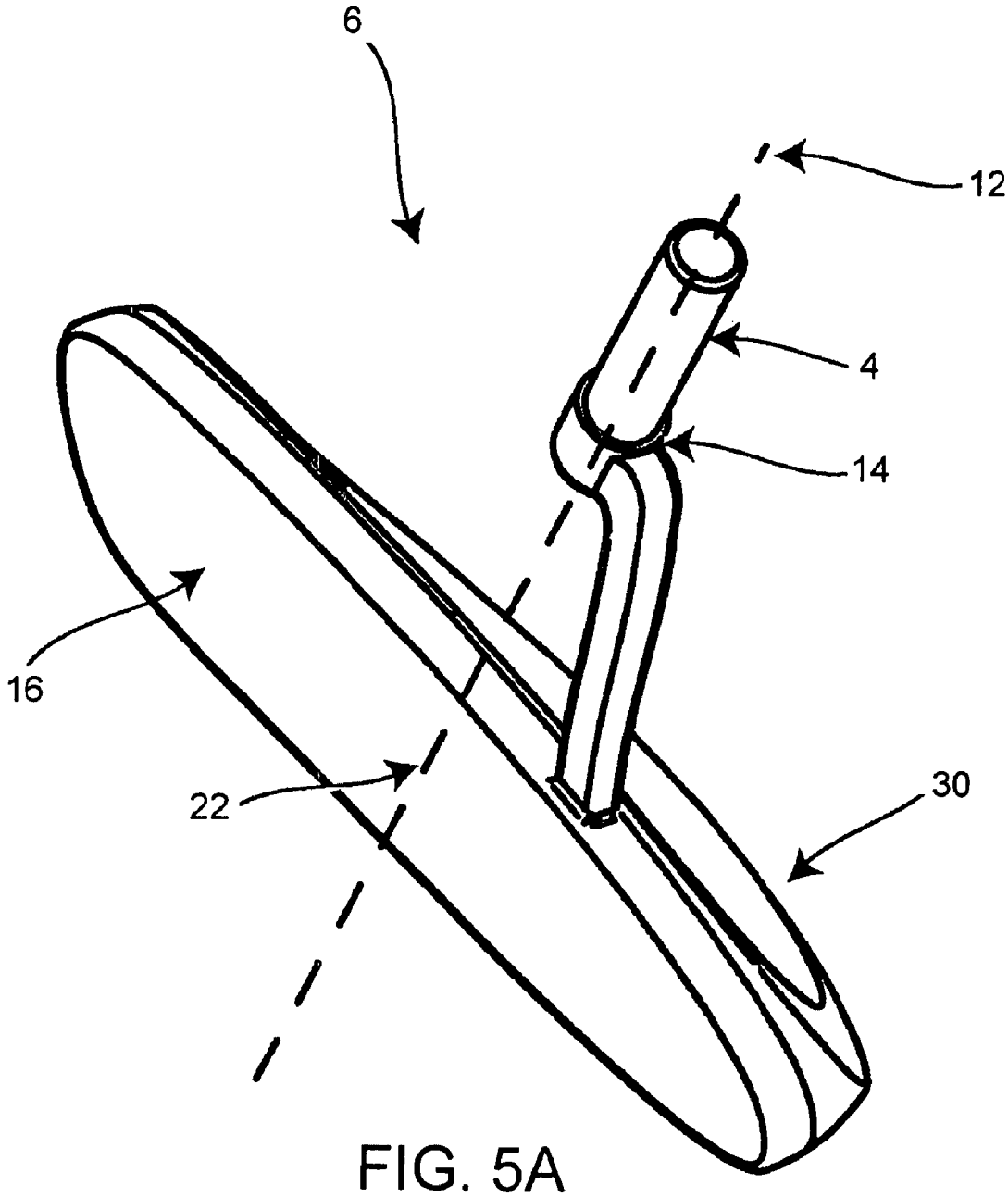
FIG. 5A is a front view of another embodiment of a golf club head.

FIG. 5A is a front view of another embodiment of head (6). This embodiment is a more traditional style putter where the axis (12) lies behind striking face (16). The putter head (6) with the center of gravity (22) on the axis (12) and slightly behind the sweet spot (23).

Figure 5B:
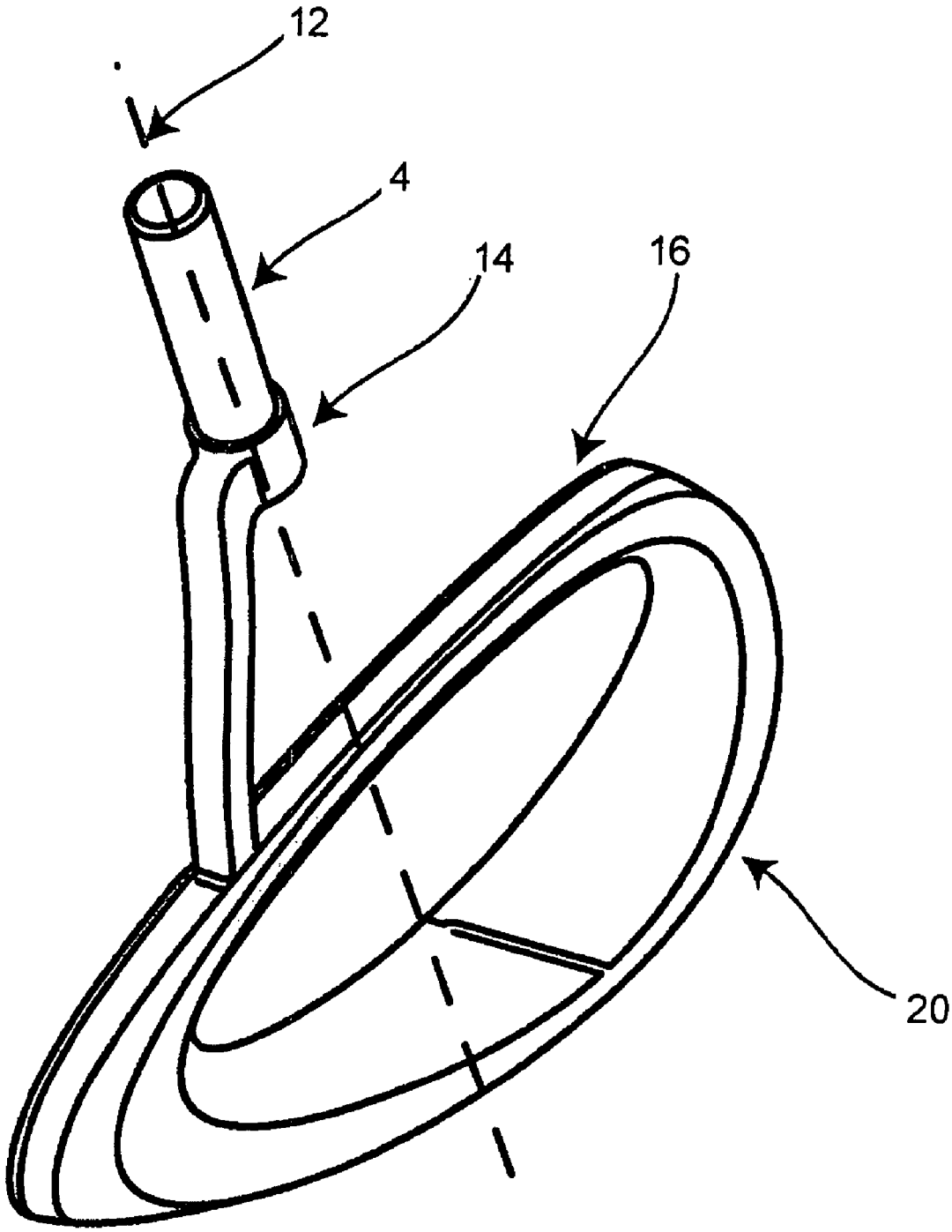
FIG. 5B is a rear view of another embodiment of a golf club head.

FIG. 5B is a back view of FIG. 5A. The trailing edge (30) may be constructed from a variety of different shapes. In the embodiment shown, the trailing edge (30) is constructed with a large cavity (31). The lack of material in the area of cavity (31) contributes to the forward shifting of the center of gravity (22). Another technique used to determine the location of the center of gravity (22) on the putter heads is the use of different density materials. Depending on the material selected for striking face (16) and trailing edge (30) the center of gravity (22) may be located either in front of or behind the striking face (16). In either case, the center of gravity (22) should be located on axis (12) or the vertical plane of axis (12). In the embodiment shown, hosel (14) is slightly behind the striking surface so the axis (12) lies slightly behind the striking face (16). The placement of the center of gravity (22) proximate to the striking face (16) is accomplished by selecting a material of significantly higher density for striking face (16) and a material of significantly lower density for trailing edge (30).

Figure 5C:
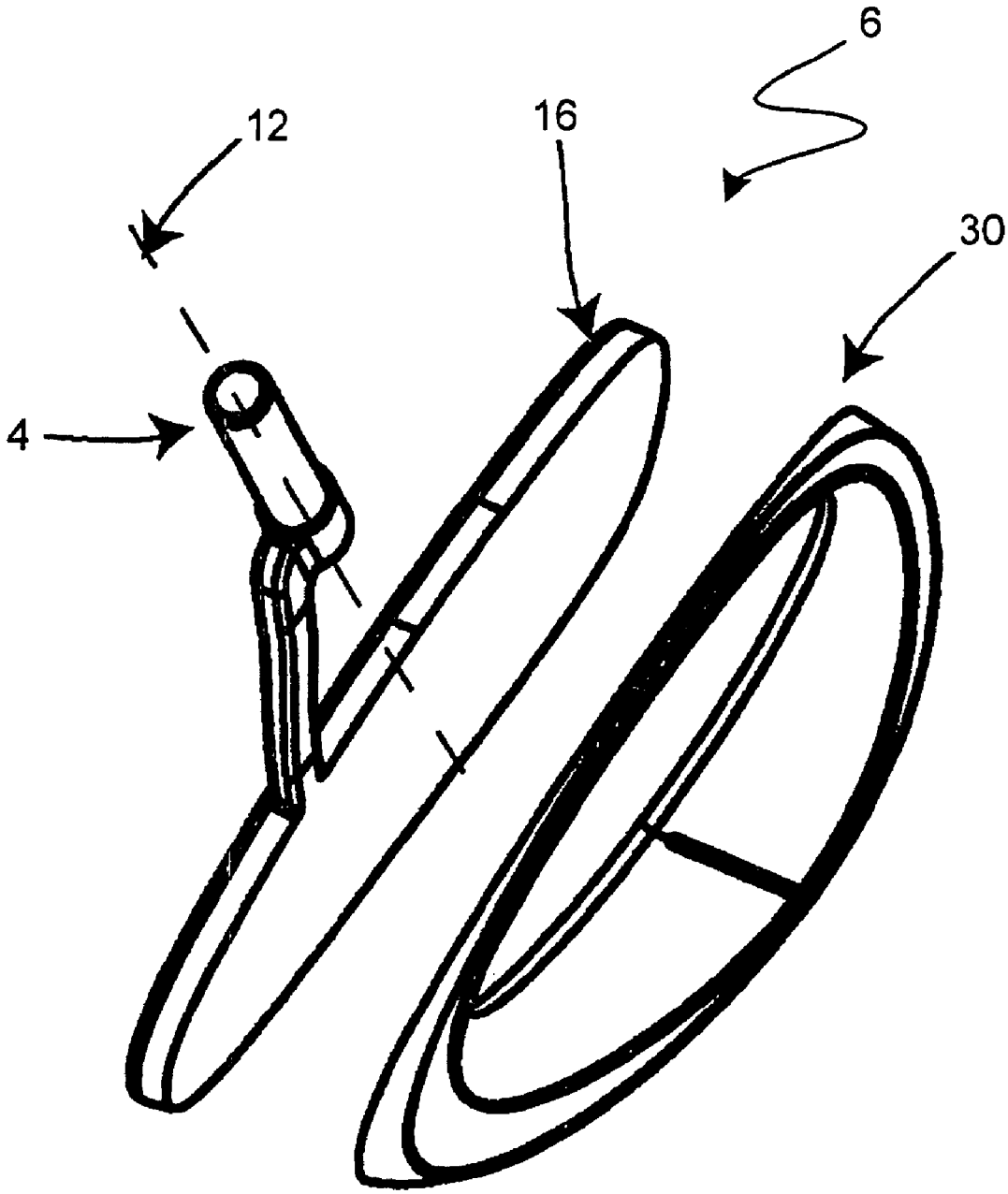
FIG. 5C is an exploded view of another embodiment of a golf club head.

FIG. 5C is an exploded view of FIG. 5A. The striking face (16) may be manufactured separately from trailing edge (30). As discussed above this gives the designer the flexibility of choosing the materials for each section. The striking face and the trailing edge may be bonded by using a variety of means known to persons of ordinary skill in the art.

A number of embodiments of the invention have been described. Nevertheless, it will be understood that various modifications may be made without departing from the spirit and scope of the invention. For example, the center of gravity can be located in front of the striking face and on the grip axis of a one-piece head by changing the shape so that a majority of the material mass is located in front of the forward face. It must be noted that for descriptive purposes, the mass distribution of head (6) above was described using a 2-dimensional frame of reference. It is understood that the mass of head (6) is distributed throughout the head (6) and not focused at points such as the toe (18) and heel (20). Given this fact, one of ordinary skill in the art will understand that many different and complex shapes can be created within the scope of the claims. Accordingly, other embodiments are within the scope of the following claims.

We claim:

1. A golf club comprising:

a shaft;

a grip at an upper end of the shaft, the grip defining a grip axis inclined with respect to the vertical, the inclined grip axis defining a vertical plane, and the grip defining a radius about the grip axis;

a head secured to a lower end of the shaft, the head having a striking face, a club head mass, a club head volume, a heel end nearest the shaft connection, a toe end furthest from the shaft connection, a sweet spot, and a trailing edge;

wherein a portion of the head between the heel end and the sweet spot projects forward of the striking face thereby producing a center of mass of the heel that is forward of the striking face;

wherein the grip axis is within a distance defined by the grip radius from the striking face, the head has a gravitational center which is further from the trailing edge than the striking face, the portion of the head between the head gravitational center and the toe end has a toe center of mass and the toe center of mass is behind the striking face, and the shaft is secured to the portion of the head between the heel end and the sweet spot that projects forward of the striking face;

wherein the gravitational center is forward of the striking face; and wherein the gravitational center of the head is less than 0.65 inch from the grip axis.

2. The golf club of claim 1, wherein the golf club is a putter.

3. The golf club of claim 1, wherein the portion of the head that projects forward of the striking face also projects forward of the vertical plane.

4. The golf club of claim 1, wherein no portion of the head between the sweet spot and the toe end extends forward of the striking face.

5. The golf club of claim 1, wherein the grip axis is at, or forward of, the striking face.

6. The golf club of claim 1, wherein the gravitational center is disposed less than about 0.84 inch forward of the striking face.

7. The golf club of claim 1, wherein the head is formed of a single material.

8. A golf club comprising:

a shaft having a grip region at an upper end, the grip region defining a grip axis; and a head secured to a lower end of the shaft, the head having a forward face, a trailing edge, a club head mass, a heel end nearest the shaft connection, a toe end furthest from the shaft connection, and a sweet spot;

wherein a portion of the head between the heel end and the sweet spot projects forward of the striking face thereby producing a center of mass of the heel that is forward of the striking face, and wherein no portion of the head between the sweet spot and the toe end extends forward of the striking face; and wherein the head has a gravitational center that is less than 0.65 inch from the grip axis and the gravitational center is at, or forward of, the forward face.

9. A golf club comprising:

a shaft having a grip region at an upper end, the grip region defining a grip axis that defines a vertical plane;

a head secured to a lower end of the shaft, the head having a striking face, a trailing edge, a club head mass, a heel end nearest the shaft connection, a toe end furthest from the shaft connection, and a sweet spot;

wherein the head from the heel end to the sweet spot has a heel center of mass that is forward of the striking face, and a portion of the head from the heel end to the sweet spot projects forward of the striking face;

wherein the head has a gravitational center that is less than 0.84 inch from the striking face, and the head from the sweet spot to the toe end has a toe center of mass that is behind the striking face; and wherein the gravitational center of the head is less than 0.65 inch from the grip axis.

10. The golf club of claim 9, wherein no portion of the head from the sweet spot to the toe end projects forward of the striking face.

11. The golf club of claim 9, wherein the gravitational center is at, or forward of, the striking face.

12. The golf club of claim 9, wherein the gravitational center is behind the striking face.

13. The golf club of claim 9, wherein the gravitational center is disposed substantially on the vertical plane.

14. The golf club of claim 9, wherein the grip axis is at, or forward of, the striking face.

15. The golf club of claim 9, wherein the golf club is a putter.

16. A golf club comprising:

a shaft having a grip region at an upper end, the grip region defining a grip axis that defines a vertical plane;

a head secured to a lower end of the shaft, the head having a striking face, a trailing edge, a club head mass, a heel end nearest the shaft connection, a toe end furthest from the shaft connection, and a sweet spot;

wherein the head from the heel end to the sweet spot has a heel center of mass that is forward of the striking face, and a portion of the head from the heel end to the sweet spot projects forward of the striking face;

wherein the head from the sweet spot to the toe end has a toe center of mass that is behind the striking face, and no portion of the head from the sweet spot to the toe end projects forward of the striking face; and wherein the head has a gravitational center that is less than 0.84 inch from the striking face, and the gravitational center is spaced less than about 0.65 inch from the vertical plane.

* * * * *